US010337743B2

(12) United States Patent
Jeanneteau et al.

(10) Patent No.: US 10,337,743 B2
(45) Date of Patent: Jul. 2, 2019

(54) ASSEMBLY UNIT FOR AN INDUCTION HOB, INDUCTION HOB AND METHOD FOR MANUFACTURING AN ASSEMBLY UNIT

(75) Inventors: Laurent Jeanneteau, Compiègne (FR); Thibaut Rigolle, Forli (IT); Alex Viroli, Forli (IT); Massimo Zangoli, Santarcangelo di Romagna (IT); Ulrich Häutle, Illertissen (DE); Klaus Schlötterer-Fratoianni, Diespeck (DE)

(73) Assignee: Electrolux Home Products Corporation N.V., Brussels (BE)

( * ) Notice: Subject to any disclaimer, the term of this patent is extended or adjusted under 35 U.S.C. 154(b) by 1421 days.

(21) Appl. No.: 12/994,700

(22) PCT Filed: May 28, 2009

(86) PCT No.: PCT/EP2009/003822

§ 371 (c)(1),
(2), (4) Date: Jul. 21, 2011

(87) PCT Pub. No.: WO2009/144022

PCT Pub. Date: Dec. 3, 2009

(65) Prior Publication Data

US 2012/0085751 A1 Apr. 12, 2012

(30) Foreign Application Priority Data

May 30, 2008 (EP) ..... 08009921

(51) Int. Cl.
*H05B 6/12* (2006.01)
*F24C 15/10* (2006.01)
(Continued)

(52) U.S. Cl.
CPC ..... *F24C 15/102* (2013.01); *F24C 7/06* (2013.01); *H05B 6/062* (2013.01); *H05B 2213/03* (2013.01)

(58) Field of Classification Search
CPC H05B 6/062; H05B 2213/06; H05B 61/1263; H05B 6/44; H05B 6/12;
(Continued)

(56) References Cited

U.S. PATENT DOCUMENTS 4,952,775 A * 8/1990 Yokoyama ..... F24D 13/022 174/489
5,614,292 A * 3/1997 Saylor ..... B32B 25/04 219/213
(Continued)

FOREIGN PATENT DOCUMENTS

DE 4007680 7/1991
DE 10258726 * 6/2004
(Continued)

OTHER PUBLICATIONS

International Search Report for PCT/EP2009/003822, dated Sep. 18, 2009, 3 pages.

*Primary Examiner* — Ibrahime A Abraham
*Assistant Examiner* — Frederick F Calvetti
(74) *Attorney, Agent, or Firm* — Pearne & Gordon LLP

(57) ABSTRACT

The invention relates to an assembly unit for an induction hob with at least one induction element has a) at least one carrying element for carrying the circuits and/or devices for supplying the at least one induction element. The at least one carrying element has a base area and side areas protruding upwards from the base area. The at least one carrying element is connectable with at least one further carrying element along a side area. The side areas have connection elements for connection with the at least one further carrying element, preferably at least one power wire slot for inserting at least one power supply wire and/or preferably at least one
(Continued)

signal wire slot for inserting at least one signal wire. Furthermore, the invention a method for manufacturing an assembly unit is described.

18 Claims, 3 Drawing Sheets

(51) Int. Cl.
*F24C 7/06* (2006.01)
*H05B 6/06* (2006.01)

(58) Field of Classification Search
CPC ..... H05B 6/36; H05B 2213/03; B23K 11/11; B23K 11/24; B25J 13/08; F24C 15/102; F24C 7/06
USPC ..... 219/602, 622, 624, 626, 627, 660–671, 219/213; 392/430, 437
See application file for complete search history.

(56) References Cited

U.S. PATENT DOCUMENTS 5,637,247 A * 6/1997 Flynn, Jr. ..... H05B 3/06 219/213
6,092,587 A * 7/2000 Ingram ..... F24D 3/14 165/171
6,182,903 B1 * 2/2001 Fiedrich ..... F24D 3/16 237/69
6,498,325 B1 * 12/2002 Akel ..... H05B 6/065 219/624
6,513,944 B2 * 2/2003 Chou ..... 362/633
6,729,054 B1 * 5/2004 VanderTuin ..... 40/452
8,740,437 B2 * 6/2014 Kim et al. ..... 362/606
2003/0052114 A1 * 3/2003 Ek ..... H05B 3/36 219/213
2008/0185376 A1 * 8/2008 Gagas ..... H05B 6/1263 219/623

FOREIGN PATENT DOCUMENTS

| | | | |
|---|---|---|---|
| EP | 0619693 | | 10/1994 |
| EP | 658069 | * | 6/1995 |
| EP | 0862714 | * | 9/1998 |
| EP | 1628506 | * | 2/2006 |
| GB | 448644 | | 6/1936 |
| GB | 2316480 | * | 2/1998 |
| GB | 2458943 | * | 10/2009 |
| WO | WO9719298 | * | 5/1997 |
| WO | WO00/30406 | * | 5/2000 |
| WO | WO2006032292 | * | 3/2006 |
| WO | 2008061916 | | 5/2008 |
| WO | WO2008/055535 | * | 5/2008 |
| WO | WO2008/058614 | * | 5/2008 |
| WO | WO2008/061916 | * | 5/2008 |

* cited by examiner

ASSEMBLY UNIT FOR AN INDUCTION HOB, INDUCTION HOB AND METHOD FOR MANUFACTURING AN ASSEMBLY UNIT

BACKGROUND OF THE INVENTION

1. Field of the Invention

The invention relates to an assembly unit for an induction hob comprising at least one carrying element for carrying the circuits and/or devices for supplying the induction element.

2. Background and Relevant Art

Induction hobs are produced with a variable number of cooking zones. For example, there are induction hobs with two zones or induction hobs with three or four zones. Normally, for these two different induction hobs, different carrying elements are necessary.

BRIEF SUMMARY OF THE INVENTION

Therefore, it is an object of the invention to propose a new assembly unit and/or a new induction hob and a corresponding method, which is/are usable for a variable number of cooking zones.

This object is solved by an assembly unit according to a first aspect, an induction hob according to a second aspect, and a method for manufacturing an assembly unit according to a third aspect. Advantageous embodiments are described particularly in variations of the above aspects.

According to a first aspect and embodiment, the invention relates to an assembly unit for an induction hob with at least one induction element, comprising a) at least one carrying element for carrying the circuits and/or devices for supplying the at least one induction element, b) wherein the at least one carrying element comprises a base area and side areas protruding upwards from the base area, c) wherein the at least one carrying element is connectable with at least one further carrying element along a side area, d) wherein the side areas comprise d1) connection elements for connection with the at least one further carrying element, d2) preferably at least one power wire slot for inserting at least one power supply wire and/or d3) preferably at least one signal wire slot for inserting at least one signal wire.

The invention according to the first aspect and embodiment allows a flexible usage of the carrying element, as it comprises the necessary elements to combine several carrying elements to an assembly unit. The induction element is preferably at least one induction coil.

The proposed assembly unit reduces the manufacturing complexity by reducing the amount of base parts. New versions can be created at least relatively easy, without generating too many new components, which increases and eases the development of the assembly unit. Furthermore, the complexity can be reduced, by limiting or reducing the amount of spare parts.

Preferably, the carrying element is formed like a box, wherein the base area has an at least substantially rectangular shape, wherein the carrying element comprises four side areas protruding upwards from the base area, wherein a) a first side area forms a first side wall, b) a second side area forms a second side wall, c) a third side area forms a third side wall opposite to the first side wall and where d) a forth side area forms a forth side wall opposite to the second side wall, wherein preferably the side of the base area adjacent to the first side wall is shorter and/or smaller then the side of the base area adjacent to the second side wall and/or wherein different carrying elements have the same connection elements. This embodiment eases the connecting of a carrying element with further carrying elements, wherein at least relatively little space is necessary.

In an advantageous embodiment, a first and a second carrying element are connectable and/or connected along their first side walls, wherein especially the first carrying element is turned with respect to the second carrying element by 180° and/or the second side wall of the first carrying element is connectable and/or connected with the forth side wall of a third carrying element.

Preferably, the power supply wire is usable for passing power to at least one further carrying element and/or the signal wire is usable for passing signals to at least one further carrying element.

In an advantageous embodiment, at least one connection element, especially a cone shaped element or a hook or a slot, has a corresponding counterpart in the opposite side area and/or connection elements, especially cone shaped elements or hooks or slots are used for connecting a carrying element with another carrying element.

In an advantageous embodiment, at least one side area comprises at least one connection element, especially a cone shaped element or a hook or a slot, wherein the at least one connection element, especially a cone shaped element or a hook or a slot, has a corresponding counterpart in the opposite side area and/or in the same area and/or wherein the least one connection element or connection elements, especially cone shaped elements or hooks or slots, are used for connecting a carrying element with another carrying element.

Preferably, one wire slot is arranged in the center of a side area and/or two wire slots are arranged with the same distance from the center of a side area. In an advantageous embodiment, a power box is insertable into the or a carrying unit or carrying element for distribution of the power to an adjacent carrying unit or carrying element and/or a circuit is insertable between adjacent carrying units or carrying element for distribution of the power to an adjacent carrying unit or carrying element.

Preferably, each carrying element defines the dimension and/or the orientation of the area for an induction element, especially an induction heating element, to be supplied and/or a carrying element is usable in different induction hobs which differ in their number of induction elements, especially induction heating elements. This allows a flexible usage of the carrying elements in different induction hobs and thus a lower number of different parts for different induction hobs.

According to another aspect, the invention relates to an induction hob comprising induction elements, especially induction heating elements, arranged in a row, a column or a two-dimensional matrix and/or each induction element, especially induction heating element, is, especially directly, connected with and/or arranged above a carrying element carrying the circuits and/or devices for supplying the induction element, especially the induction heating element. This means that the induction elements can be supplied with power effectively and with short cables.

Preferably, the carrying elements form a plug-in system with all components necessary for supplying the induction heating elements. This allows a cost and time-effective manufacturing.

Furthermore, the invention relates to a method for manufacturing an assembly unit, a) wherein at least two carrying elements are connected, b) wherein a first and a second carrying element are connected along their first side walls, where especially the first carrying element is turned with respect to the second carrying element by 180° and/or c) wherein the second side wall of the first carrying element is connected with the forth side wall of a third carrying element.

BRIEF DESCRIPTION OF THE DRAWINGS

The invention will be now described in further details with references to the figures, in which FIG. 1 describes an assembly unit according to the invention with a single carrying element, FIG. 2 describes an assembly unit according to the invention with two carrying elements arranged side by side, FIG. 4 shows another assembly unit according to the invention with four carrying elements arranged along their back sides and along their sides and in which

DETAILED DESCRIPTION OF THE PREFERRED EMBODIMENTS

Figure 1:
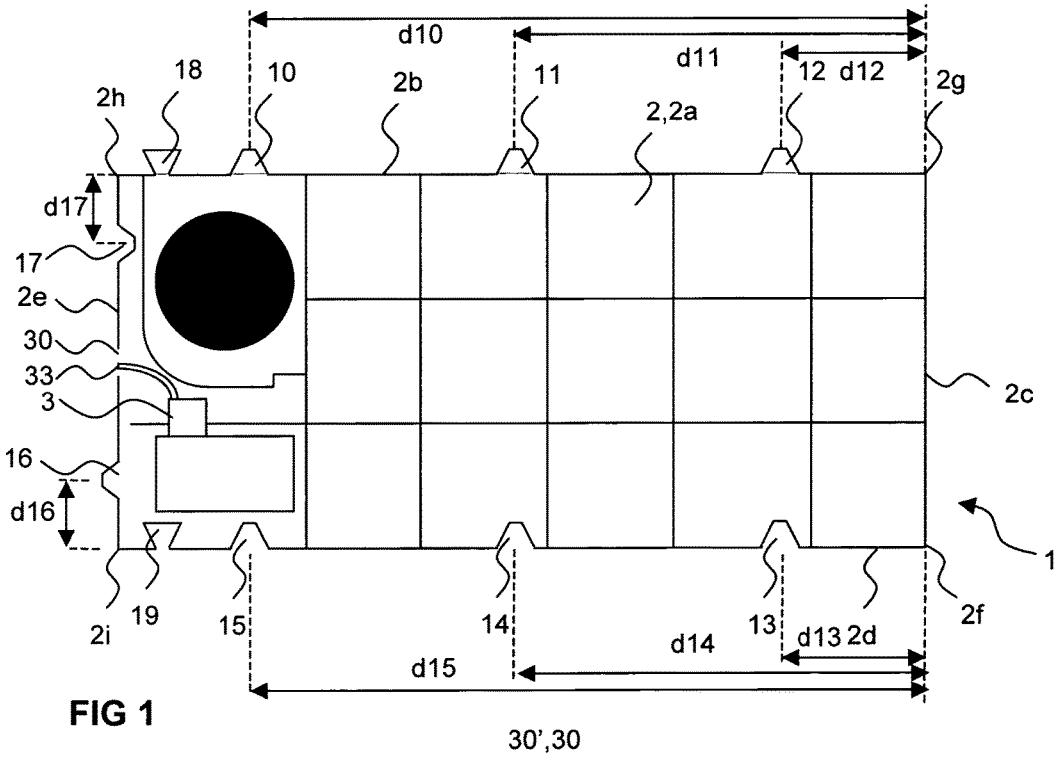

FIG. 1 shows an assembly unit 1 comprising one carrying element 2 with circuits and/or devices 3 for supplying the induction element.

The carrying element 2 is formed like a box. The base area 2*a* has an at least substantially rectangular shape. The carrying element 2 comprises four side areas 2*b* to 2*e* protruding upwards from the base area 2*a*. The first side area 2*e* forms a first side wall, the second side area 2*b* forms a second side wall, the third side area 2*c* forms a third side wall opposite to the first side wall 2*e* and the forth side area 2*d* forms a forth side wall opposite to the second side wall. The side walls 2*b* to 2*e* form corners 2*f* to 2*i*, where corner 2*f* is arranged between side walls 2*d* and 2*c*, where corner 2*g* is arranged between side walls 2*c* and 2*a*, where corner 2*h* is arranged between side walls 2*b* and 2*e* and where corner 2*i* is arranged between side walls 2*e* and 2*d*.

Figure 2:
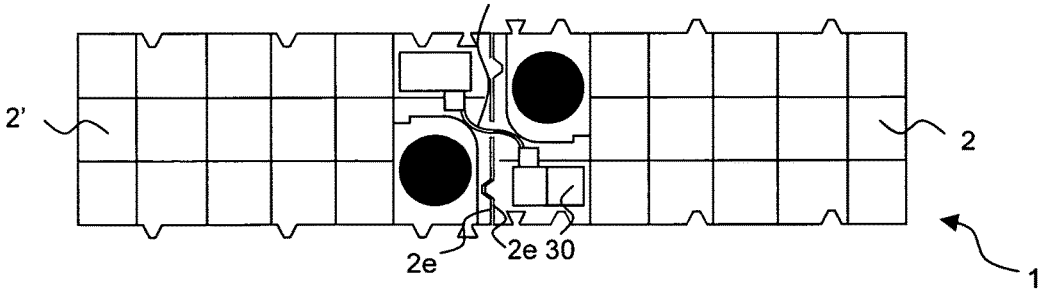

As can be seen from FIG. 2, the carrying element 2 is connectable and connected with a further carrying element 2' along the side 2*e* of the carrying element 2 and the side 2*e'* of the carrying element 2'. Both carrying elements 2 and 2' have the same connection elements 10 to 19.

The side areas 2*b* to 2*e* comprise connection elements 10 to 19 along their surfaces, where the side 2*b* comprises four connection elements 10, 11, 12 and 18 protruding like a cone and away from the base area 2*a*.

Connection element 10 has a distance d10, connection element 11 has a distance d11, connection element 12 has a distance d13 and, not shown, connection element 18 has a distance d18 from the corner 2*g*.

The opposite side 2*d* comprises four connection elements 13, 14, 15 and 19 protruding inwards in the direction of the base area 2*a*. The connection elements 13, 14, 15 and 19 are also formed like a cone, however, they are formed as a counterpart with respect to the connection elements 10, 11, 12 and 18.

Connection element 13 has a distance d13, connection element 14 has a distance d14, connection element 15 has a distance d15 and, not shown, connection element 19 has a distance d19 from the corner 2*f*.

To be able to connect two carrying elements 2 and 2" along their corresponding sides 2*d* and 2*b*, the distance d13 is equal to the distance d12, the distance d14 is equal to the distance d11, and the distance d15 is equal to the distance d10 and the distance d18 (not shown) of the element 18 is equal to the distance d19 (not shown) of the element 19. Furthermore, along the short side 2*e*, one connection element formed like a cone with reference No. 16 is arranged, which protrudes away from the base area 2*a*.

In the upper part of the side area 2*e*, another connection element 17 is arranged, which, however, protrudes inwards into the direction of the base area 2*a* and which is also formed like a cone and forms a counterpart with respect to the connecting element 16.

Connection element 17 has a distance d17 from the corner 2*h* and connection element 16 has a distance d16 from the corner 2*i*.

To be able to connect two carrying elements 2 and 2' along their sides 2*e*, the distance d16 is equal to the distance d17.

Furthermore, in the side area 2*e*, a slot 30 is provided for inserting power cables 33, which are passed from the carrying element 2 to another carrying element 2'.

The slot 30 has the same distance from corner 2*h* and from corner 2*i*.

Into this slot, also signal cables can be inserted, which transmit signals from a carrying element 2 to another carrying element 2'.

Figure 3:
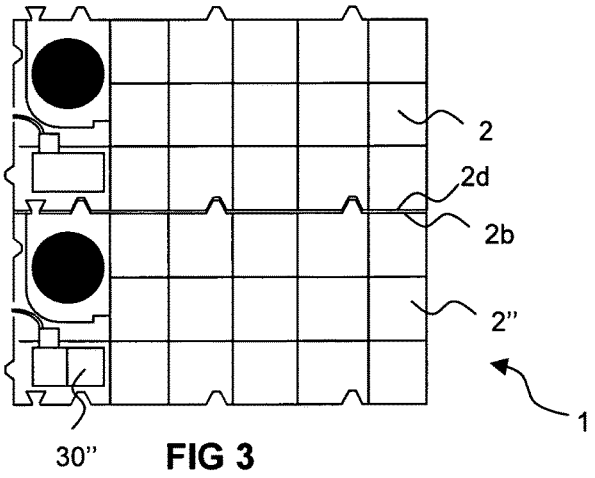
FIG. 3 shows another assembly unit with two carrying elements arranged along their back sides.

FIG. 3 shows another embodiment according to the invention, with a carrying element 2 combined with a carrying element 2" along its lower longer side 2*d*. The carrying element 2" is connected with a carrying element 2 along its upper longer side 2*b*.

Figure 4:
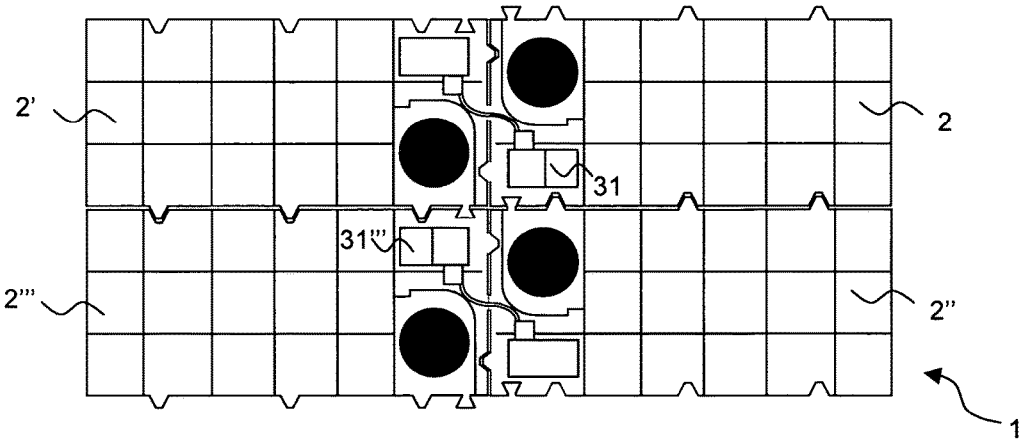

FIG. 4 shows another embodiment of an assembly unit 1 according to the invention, with a carrying element 2 and three further carrying elements 2', 2" and 2". The four carrying elements are connected with each other. The carrying element 2 is connected with the carrying element 2' along its left side area 2*e* and with the carrying element 2" along its side 2*d*. The three further carrying elements 2', 2" and 2" have connections in a corresponding way, so that they form two rows and two columns.

Figure 5:
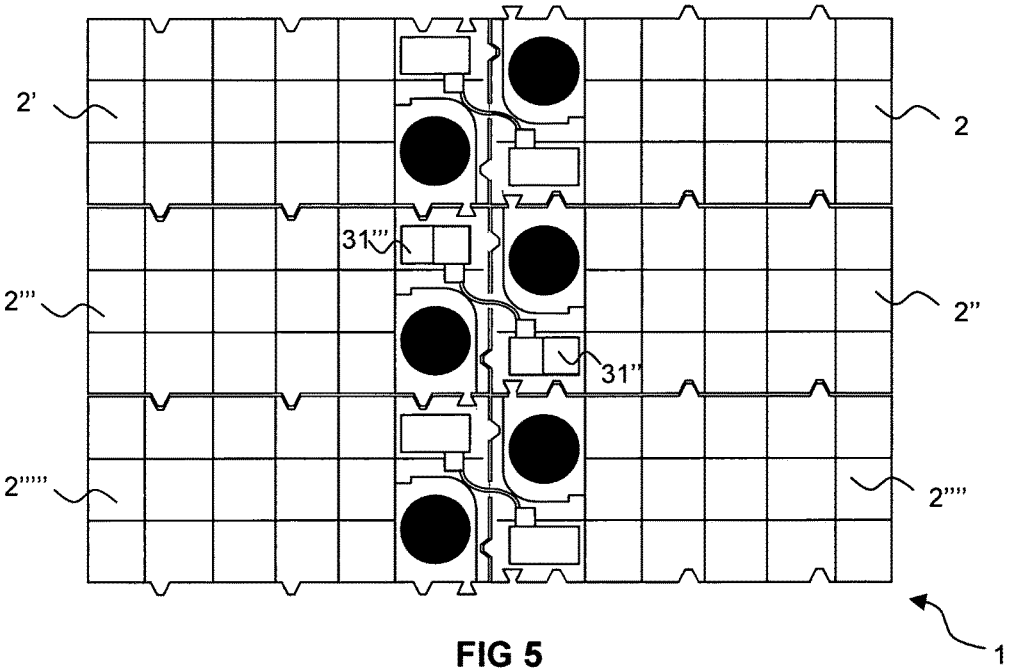
FIG. 5 shows another embodiment of an assembly unit according to the invention comprising six carrying elements arranged side by side and along their back sides.

FIG. 5 shows another embodiment of the invention with the assembly unit 1 with six carrying elements 2, 2', 2", 2", 2"" and 2""". The form three rows and two columns.

If a single carrying or box element is used, a cable for power supply can be placed.

If two carrying elements are connected side by side a power box 31 is inserted in one or both carrying elements and the power is passed via the wire slots, the signal wires are passed also using the wire slots 30.

If two carrying elements are connected back to back, also at least one power pox 31 is used. Furthermore, a circuit for wire distribution is used.

The box design is minimized for a simple manufacturing tool. For fixing the carrying elements side by side, besides the cone shape, hooks and/or slots can be added. The fixing back to back is made by a cone shape.

For manufacturing of the assembly unit 1, the needed number of carrying elements 2 is simply pushed into each other, and, afterwards, the necessary cables are inserted.

If necessary, also power boxes 31 and circuits for wire distribution are included.

Each carrying element 2 defines the dimension and the orientation of the area for an induction heating element to be supplied, which is not shown in the figures. The carrying elements 2 are usable in different induction hobs which differ in their number and/or arrangement of heating elements.

The induction hob can comprise induction heating elements which can be arranged in a row, a column or a two-dimensional matrix.

Each induction heating element is connected and arranged above a carrying element 2 carrying the circuits and devices 3 for supplying the induction heating element.

The carrying elements 2 form a plug-in system with all components necessary for supplying the induction heating elements.

LIST OF REFERENCE SIGNS

1 assembly unit
2, 2', 2", 2", 2", 2' carrying elements
2*a* base area
2*b*-2*e* side areas
2*f*-2*h* corners
3 induction supplying devices
10-19 connection elements
30 wire slot
31 power box
33 power supply wire
d10-d17 distances

We claim:

1. An assembly unit for an induction hob with at least one induction element, comprising:

a first carrying element and a second carrying element respectively carrying a first set and a second set of devices that respectively supply a first and a second induction element, the first and second carrying elements each comprising a base area, the base area comprising sides protruding upward from the base area, a first one of the sides comprising a protrusion extending away from the base area, a second one of the sides being positioned opposite the first side and comprising a recess extending into the base area, a third one of the sides extending between an edge of the first side and an edge of the second side and comprising a protrusion and a recess, wherein the recess and the protrusion of the third side of the first carrying element are respectively coupled to the protrusion and the recess of the third side of the second carrying element.

2. The assembly unit according to claim 1, further comprising:

a third carrying element carrying a third set of devices that supplies a third induction element, the third carrying element comprising a base area, the base area comprising sides protruding upward from the base area, a first one of the sides comprising a protrusion extending away from the base area, a second one of the sides being positioned opposite the first side and comprising a recess extending into the base area, a third one of the sides extending between an edge of the first side and an edge of the second side and comprising a protrusion and a recess, wherein the protrusion of the first side of the first carrying element is coupled to the recess of the second side of the third carrying element, and wherein the first carrying element is inversely oriented with respect to the second carrying element.

3. The assembly unit according to claim 1, further comprising:

at least one power supply wire extending through the third sides of the first and second carrying elements and passing power between the first and the second carrying elements, each of the third sides of the first and second carrying elements further comprising at least one power wire slot through which the power supply wire extends from the first carrying element to the second carrying element.

4. The assembly unit according to claim 3, wherein the power supply wire passes signals between the first and the second carrying elements.

5. The assembly unit according to claim 3, wherein the power wire slots of the first and second carrying elements are respectively arranged in a center of third sides of the first and third carrying elements.

6. The assembly unit according to claim 5, wherein two of the wire slots are arranged within the same distance from a center of each of the third side areas of the first and second carrying elements.

7. The assembly unit according to claim 2, wherein the protrusion of the first, second, and third carrying elements has a shape of one of an outwardly pointing cone or an inwardly pointing cone, and wherein the recess of the first, second, and third carrying elements corresponds with the shape of the protrusion.

8. The assembly unit according to claim 1, wherein the first and second carrying elements each further comprise a power box that distributes power between the first carrying element and the second carrying element.

9. The assembly unit according to claim 1, wherein the base area and the sides of each carrying element define dimensions and an orientation of a corresponding one of the induction elements fitting therein, the base area having the shape of a rectangle.

10. An assembly unit according to claim 1, further comprising:

an induction hob comprising induction heating elements arranged according to an arrangement of the first and second carrying elements.

11. The assembly unit according to claim 1, wherein the carrying elements form a plug-in system.

12. The assembly unit according to claim 2, further comprising:

a fourth carrying element carrying a fourth set of devices that supply a fourth induction element, the fourth carrying element comprising a base area, the base area comprising sides protruding upward from the base area, a first one of the sides comprising a protrusion extending away from the base area, a second one of the sides being positioned opposite the first side and comprising a recess extending into the base area, a third one of the sides extending between an edge of the first side and an edge of the second side and comprising a protrusion and a recess, wherein the protrusion of the first side of the second carrying element is coupled to the recess of the second side of the fourth carrying element, and wherein the recess and the protrusion of the third side of the third carrying element are respectively coupled to the protrusion and the recess of the third side of the fourth carrying element.

13. The assembly unit according to claim 1, wherein a circuit is inserted between each of the carrying elements, the circuit of the first carrying element and the circuit of the second carrying element distributing power between each other.

14. The assembly unit according to claim 1, wherein the carrying elements are used in induction hobs having a differing number of induction heating elements.

15. An induction hob comprising the assembly unit according to claim 1, wherein an induction heating element is directly connected with and arranged above the first and second carrying elements carrying the devices the induction heating element.

16. An assembly unit for an induction hob with at least one induction element, comprising:

a first carrying element and a second carrying element respectively carrying a first set and a second set of devices that respectively supply a first and a second induction element, the first and second carrying elements each comprising a base area, the base area comprising sides protruding upward from the base area, a first one of the sides comprising a protrusion extending away from the base area, a second one of the sides being positioned opposite the first side and comprising a recess extending into the base area, a third one of the sides extending between an edge of the first side and an edge of the second side and comprising a protrusion and a recess, wherein the protrusion of the first side of the first carrying element is coupled to the recess of the second side of the second carrying element.

17. The assembly unit according to claim 16, further comprising:

a third carrying element carrying a third set of devices that supply a third induction element, the third carrying element comprising a base area, the base area comprising sides protruding upward from the base area, a first one of the sides comprising a protrusion extending away from the base area, a second one of the sides being positioned opposite the first side and comprising a recess extending into the base area, a third one of the sides extending between an edge of the first side and an edge of the second side and comprising a protrusion and a recess, wherein the recess and the protrusion of the third side of the first carrying element are respectively coupled to the protrusion and the recess of the third side of the third carrying element, and wherein the first carrying element is inversely oriented with respect to the third carrying element.

18. The assembly unit according to claim 17, further comprising:

a fourth carrying element carrying a fourth set of devices that supply a fourth induction element, the fourth carrying element comprising a base area, the base area comprising sides protruding upward from the base area, a first one of the sides comprising a protrusion extending away from the base area, a second one of the sides being positioned opposite the first side and comprising a recess extending into the base area, a third one of the sides extending between an edge of the first side and an edge of the second side and comprising a protrusion and a recess, wherein the protrusion of the first side of the third carrying element is coupled to the recess of the second side of the fourth carrying element, and wherein the recess and the protrusion of the third side of the second carrying element are respectively coupled to the protrusion and the recess of the third side of the fourth carrying element.

* * * * *